US005482142A

United States Patent [19]

Kulak

[11] Patent Number: 5,482,142

[45] Date of Patent: Jan. 9, 1996

[54] QUIET ELEVATOR ROTARY GATE SWITCH

[75] Inventor: Richard E. Kulak, Bristol, Conn.

[73] Assignee: Otis Elevator Company, Farmington, Conn.

[21] Appl. No.: 221,717

[22] Filed: Mar. 31, 1994

[51] Int. Cl.[6] ..... B66B 13/00

[52] U.S. Cl. ..... 187/280; 200/61.62

[58] Field of Search ..... 187/280, 301, 187/316; 200/6 R, 61.62, 61.41, 61.73, 284

[56] References Cited

U.S. PATENT DOCUMENTS 2,639,007 5/1953 Zippler ..... 187/280

4,352,964 10/1982 English ..... 200/6 R 4,870,230 9/1989 Osika et al. ..... 200/6 R 5,203,431 4/1993 Donohoe et al. ..... 187/31

*Primary Examiner*—Kenneth Noland

[57] ABSTRACT

An elevator rotary gate switch has a camming surface which is always in contact with a lead of an electrical circuit during operation. The camming surface has an electrical contact or bridge thereon. The camming surface is attached to a lever which intersects at an acute angle with a roller traveling with an elevator door. The roller forces the lever, and the camming surface thereby, to pivot the lead along the camming surface into or out of contact with the bridge as an elevator door moves into and out of position.

4 Claims, 3 Drawing Sheets

QUIET ELEVATOR ROTARY GATE SWITCH

TECHNICAL FIELD

This invention relates to elevators and more particularly to quiet switch for detecting elevator door position.

BACKGROUND OF THE INVENTION

Passenger elevators generally have a cab having a pair of doors and a landing having a pair of hoistway doors. Both the cab and hoistway doors open and close approximately in register with each other to allow passengers to enter and exit the elevator cab. It is important to be certain of the position of the elevator doors and of the cab itself.

A gate switch is used in elevators to signal a controller that the elevator doors are in the proper position to permit safe elevator operation. The gate switch has a holder that rotates a pair of electrical contacts into contact with a pair of stationary electrical leads. If the contacts hit or disengage from the leads, a signal is sent to a controller to indicate that the door, for example, is in or out of the proper position. Unfortunately, a contact striking a lead creates undesirable noise. Further, the contacts may bounce away from the leads, which may lead to maintenance and operation problems.

DISCLOSURE OF THE INVENTION

It is an object of the invention to provide a reliable, relatively trouble-free rotary gate switch.

It is a further object of the invention to provide a gate switch which operates in a relatively noise free manner.

According to the invention, a rotary gate switch has a camming surface which is always in contact with a lead of an electrical circuit during operation. The first surface has an electrical contact or bridge thereon. The first surface is attached to a lever which intersects at an acute angle with a roller traveling with an elevator door. The roller forces lever and the second surface thereby to pivot the lead along the first surface into or out of contact with the bridge as the door moves into and out of the position. The lever is held at an acute angle by gravity.

These and other objects, features, and advantages of the present invention will become more apparent in light of the following detailed description of a best mode embodiment thereof, as illustrated in the accompanying drawing.

BEST MODE FOR CARRYING OUT THE INVENTION

Figure 1:
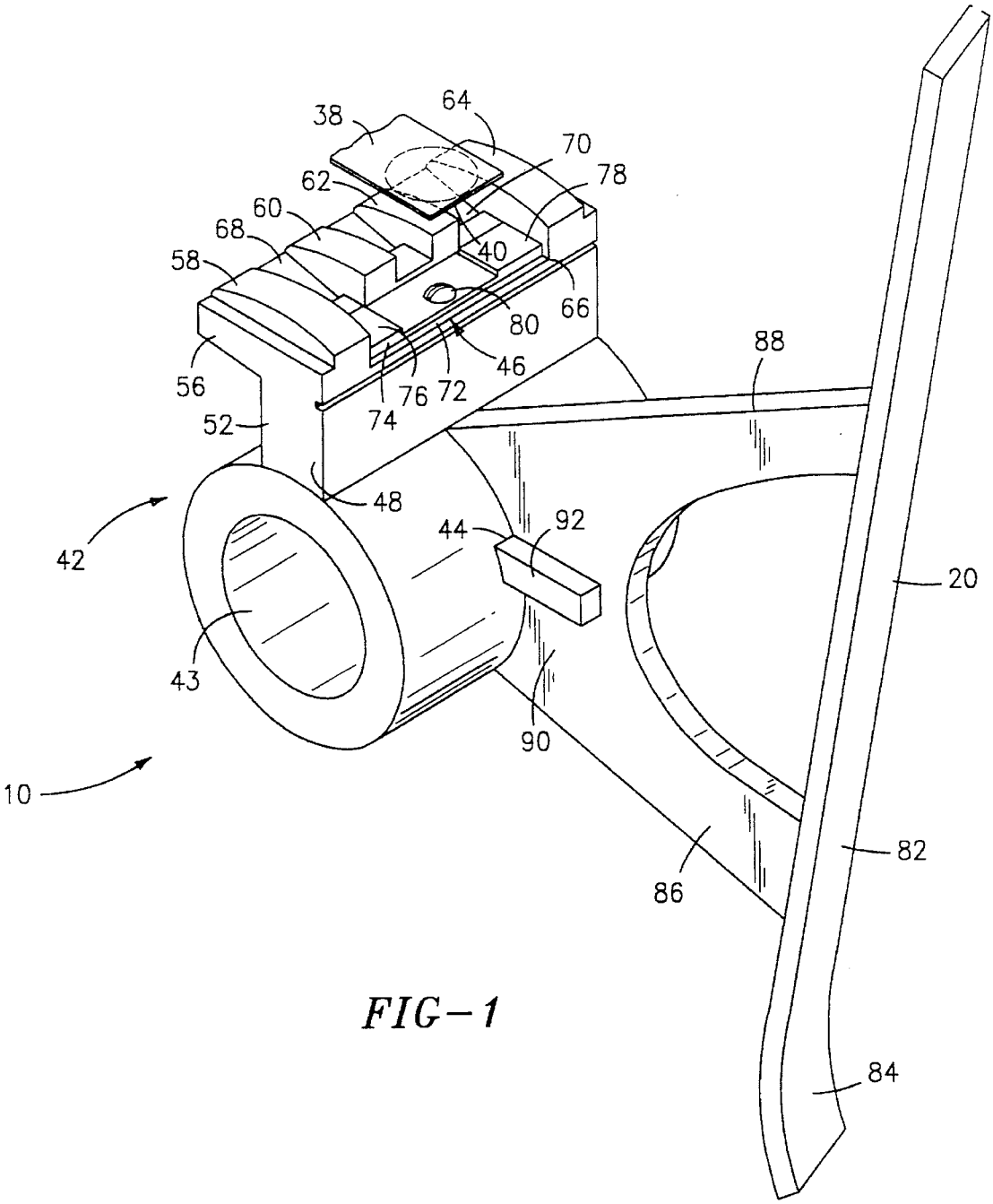
FIG. 1 is a perspective, mirror image view of a switch that is utilized in the invention.

Referring to FIG. 1, a rotary switch 10 is shown. The switch 10 has a plastic body 42 having a camming portion 56 holding a bridge 46, and a contact lever 20.

The body 42 has a journal opening 43, a keyed slot 44 for receiving and connecting to the lever 20 and an extension piece 52 connecting the camming portion 56. The journal opening encloses and rotates upon stationary shaft 22 (see FIGS. 2 and 3).

The camming portion has a platform 56 having a first camming surface 58, a second camming surface 60, a third camming surface 62, a fourth camming surface 64, and a rectangular indentation 66 for receiving the bridge 46. A first channel 68 is formed between the first and second camming surfaces and a second channel 70 is formed between the third and fourth camming surfaces. The channels have sufficient width and depth to allow edges of contact buttons 40 (see FIGS. 2 and 3) to travel along the edges of the respective camming surfaces 58–60. By allowing the buttons to travel along their edges, the portion of the buttons 40 that contact the bridge 46 do not contact the plastic material of the switch thereby avoiding the transfer of any of that material to the button. Contact between each button contact 40 and the bridge 46 is metal to metal thereby insuring long life and reliability.

The bridge 46 has a first layer 72 of a conductive material, such as copper, and a second layer 74 of a highly conductive material such as silver. The second layer 74 has a first raised contact portion 76 and a second raised contact portion 78 for engaging the buttons 40. The first raised portion aligns with channel 68 and the second raised contact portion aligns channel 70. The bridge is attached to the platform 56 within the rectangular indentation 66 by a screw 80 or the like.

The lever 20 has a flat contact surface 82 having a curved end portion 84, a pair of legs 86, 88 converging into a portion 90 for engaging the plastic body, and a key 92 disposed upon the portion. The portion has a circular opening (see FIGS. 2 and 3) for receiving the shaft 22. The key engages the body on both sides of the journal opening (see FIGS. 2 and 3) so that the lever and the body rotate together about the shaft. The legs are conventionally attached and are offset from the center of the contact surface so that gravity tends to urge the contact surface 82 to hang down (see FIG. 2) at an acute angle as will be discussed infra. The contact surface engages an impacting mechanism such as roller 104 which moves with an elevator door (not shown).

Figure 2:
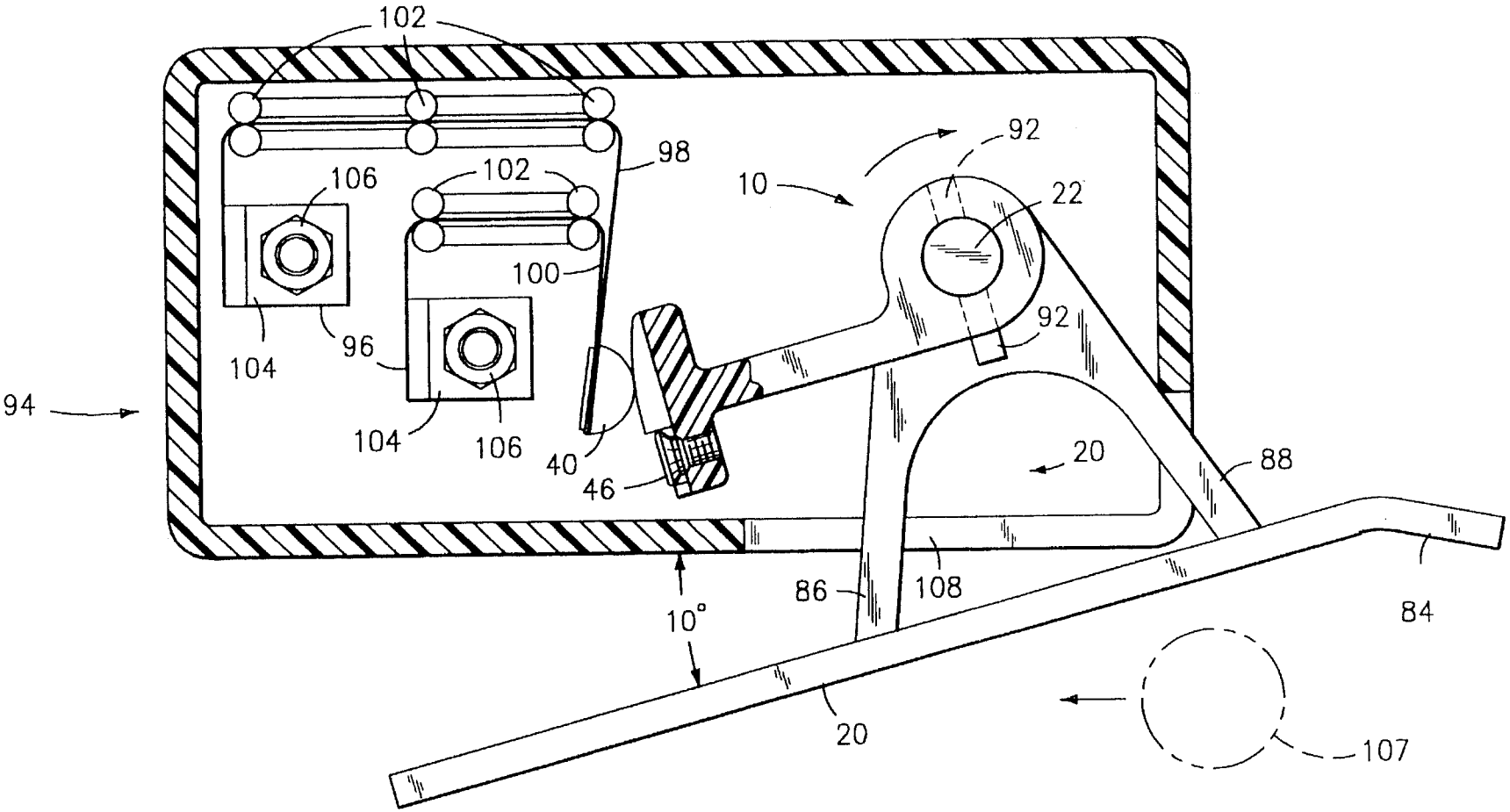
FIG. 2 is a schematic view of a rotary gate switch of the invention in a disengaged position.
Figure 3:
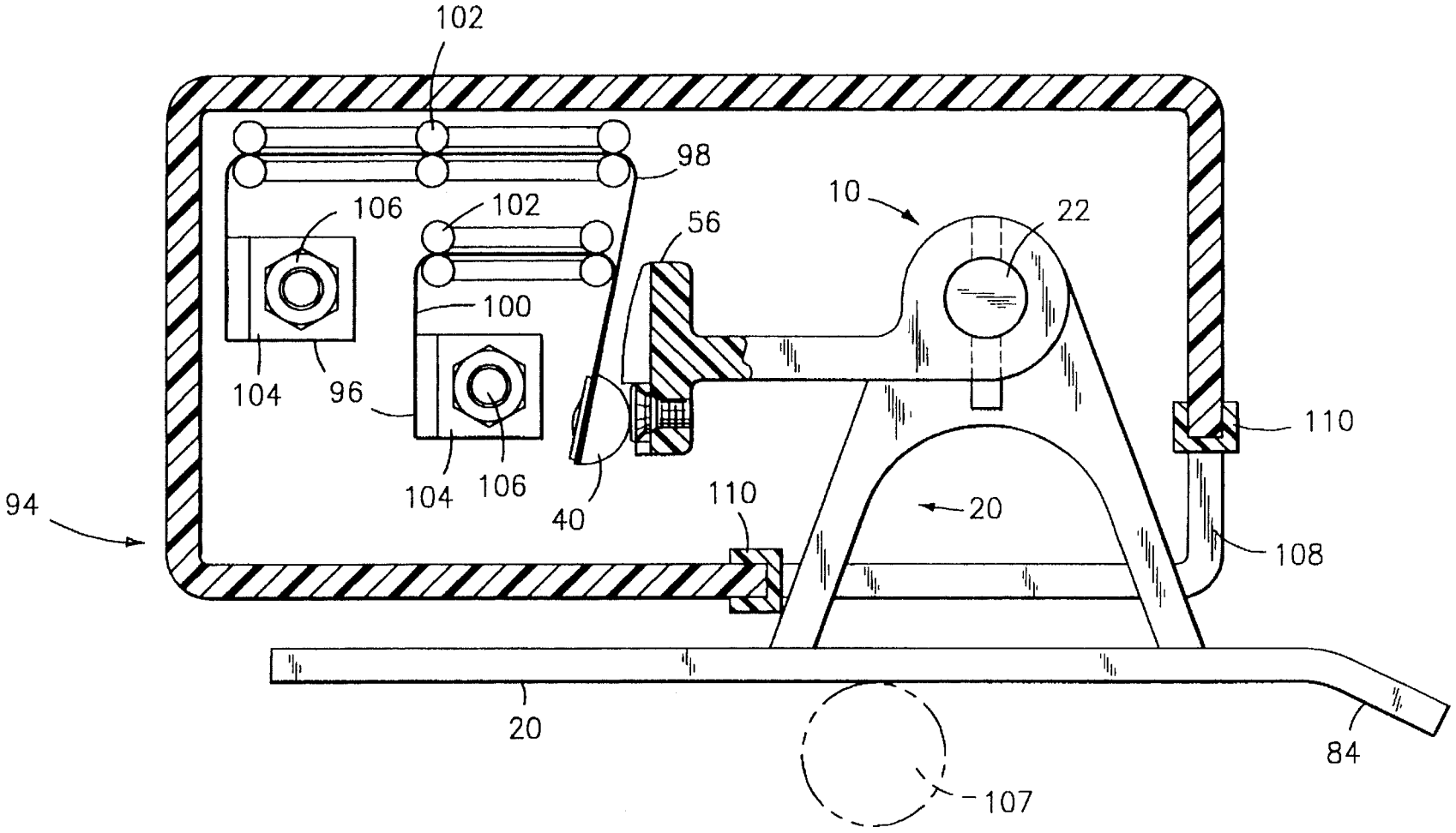
FIG. 3 is a schematic view of a rotary gate switch of the invention in an engaged position.

Referring to FIGS. 2 and 3, the rotary gate switch employing switch 10 is shown. The gate switch comprises a housing 94, rotary switch 10, shaft 22, lever 20, a pair of wire terminals 96, a pair of electrical leads 98, 100, and a plurality of contact holders 102.

The wire terminals 96 each have a bracket 104 attaching to a lead and attaching by conventional means to a controller (not shown). The brackets are attached to the housing 94 by screws 106. Each wire terminal is conventionally attached to a button 40 which is in contact with the rotary switch as described above. As shown, one button and one lead is disposed behind the other button and lead (see FIGS. 2 and 3).

The housing 96 is a plastic box having; a conventional bearing (not shown) for fixedly holding the shaft 22, and an opening 108 through which the legs extend, and a seat (not shown) for receiving each screw. The opening 108 is dimensioned and the lever is weighted (due to the placement of legs 86, 88) so that if the contact surface 82 is not in contact with the roller 107, the right leg (see FIG. 2) engages the housing to maintain the contact surface at about a 10° angle relative to the housing. The housing may have bumpers 110 (see FIG. 3) attached to the edges of the opening to minimize damage to both the legs or the housing during switch operation and to minimize contact noise. The leads 98, 100 are positioned by the contact holders 102 to allow the leads to exert a spring force upon the rotary switch so that the buttons 40 are maintained in contact with the rotary switch at all times.

To construct the switch, the portion 90 of the lever and the key 92 are inserted into the slot 44. The opening of the portion and the journal opening 43 are inserted over the stationary shaft 22. Because the key connects the portion 90 of the lever to the switch, both parts rotate about the switch if either part experiences rotational movement.

In operation, referring to FIG. 2, if not in contact with the roller 107, gravity maintains the lever at an acute angle relative to the housing, preferably at about 10° or less. The angle minimizes the impact with the roller 104 to minimize noise and provides an appropriate range of motion so that the buttons remain on the camming surfaces. A roller rolls along the lever during impact to minimize wear on both the impacting mechanism and the lever. In this position, the buttons 40 are out of contact with the bridge or contact.

Referring to FIG. 3, if a door (not shown) moves into position, the roller 104 impacts the lever 22, causing the switch to rotate thereby causing the buttons 40 to slide into contact with the bridge 46 making an electrical connection. If the roller moves with its carrier away from the lever, gravity urges the lever to rotate back to its position as shown in FIG. 2. The buttons are no longer in contact with the bridge and the electrical connection is broken. If the switch is frozen in position (i.e. due to a short circuit etc.), the curved portion 84 of the lever is impacted by the roller thereby causing the switch to disconnect the buttons from the bridge.

Because the buttons are always in contact with the switch, there is no excessive noise or lead rebounding. Because the impact angle between the roller and the lever is minimized, the forces on the lever are minimized thereby minimizing noise and component wear.

Although, the invention has been shown and described with respect to a best mode embodiment thereof, it should be understood by those of ordinary skill in the art, that various omission, changes and additions in the form and detail thereof may be made without departing from the spirit and scope of the invention. One of ordinary skill in the art will recognize that other impacting mechanisms besides a roller may be used.

We claim:

1. An elevator rotary gate switch which bridges a lead of an electrical circuit, said switch comprising:

a housing an electrical lead disposed within said housing, a rotatable camming surface disposed within said housing, said electrical lead impinging and traveling upon said camming surface throughout a range of operation of said switch, an electrical contact attached to said surface, a contact surface attached to said camming surface and extending outside said housing, said contact surface for engaging an external elevator stimulus at an acute angle relative to said housing, such that upon impact said contact surface causing said camming surface to rotate thereby moving said lead along said camming surface into and out of contact with said electrical contact and, an opening in said housing through which said contact surface extends, said opening cooperating with said contact surface to limit said acute angle at which said contact surface engages said external stimulus.

2. The elevator gate switch of claim 1 further comprising:

wherein said angle is approximately 10°.

3. An elevator rotary gate switch which bridges a lead of an electrical circuit, said switch comprising:

a housing an electrical lead disposed within said housing, a rotatable camming surface disposed within said housing, said electrical lead impinging and traveling upon said camming surface throughout a range of operation of said switch, an electrical contact attached to said surface, a linkage attaching to said surface, a contact surface attached to said linkage, said linkage extending outside and below said housing for engaging an external elevator stimulus at an acute angle relative to said housing such that impact by said surface of said stimulus causes said camming surface to rotate thereby moving said lead along said camming surface into and out of contact with said contact, said linkage attaching to said contact surface so that gravity causes said contact surface to assume said angle.

4. An elevator rotary gate switch which bridges a lead of an electrical circuit, said switch comprising:

a housing, an electrical lead disposed within said housing, a rotatable camming surface disposed within said housing, said electrical lead impinging and traveling upon said camming surface throughout a range of operation of said switch, an electrical contact attached to said surface, a contact surface attached to said camming surface and extending outside said housing, said contact surface for engaging an external elevator stimulus at an acute angle relative to said housing, such that upon impact, said contact surface causing said camming surface to rotate thereby moving said lead along said camming surface into and out of contact with said electrical contact, said contact surface being disposed below said housing and attaching to said camming surface such that said contact surface assumes said acute angle by gravity if not in contact with said stimulus.

* * * * *